US008250677B2

(12) United States Patent
Nicolosi et al.

(10) Patent No.: US 8,250,677 B2
(45) Date of Patent: Aug. 28, 2012

(54) PENIS COVERING

(75) Inventors: Ramona C. Nicolosi, Portsmouth, NH (US); Sharon Stevens, Portsmouth, NH (US)

(73) Assignee: Synhergy Holding LLC, Portsmouth, NH (US)

( * ) Notice: Subject to any disclaimer, the term of this patent is extended or adjusted under 35 U.S.C. 154(b) by 0 days.

(21) Appl. No.: 11/935,536

(22) Filed: Nov. 6, 2007

(65) Prior Publication Data

US 2009/0113605 A1 May 7, 2009

(51) Int. Cl.
*A41B 9/02* (2006.01)
*A41B 9/00* (2006.01)

(52) U.S. Cl. ..... 2/403; 2/400; 602/60; 602/63

(58) Field of Classification Search ..... 2/400–403, 2/163, 159; 602/67–72, 60, 61, 22, 30, 62, 602/63, 75, 73; 600/38–41
See application file for complete search history.

(56) References Cited

U.S. PATENT DOCUMENTS

| | | | | | |
|---|---|---|---|---|---|
| 440,434 | A | * | 11/1890 | McCarty | 602/30 |
| 3,039,460 | A | * | 6/1962 | Chandler | 602/22 |
| 3,063,446 | A | * | 11/1962 | Levitt | 602/30 |
| 3,200,415 | A | | 3/1963 | Breece, Jr. | |
| 3,556,091 | A | * | 1/1971 | Haig | 602/30 |
| 4,023,216 | A | | 5/1977 | Li | |
| 4,197,849 | A | | 4/1980 | Bostick | |
| 4,284,079 | A | | 8/1981 | Adair | |
| 4,453,938 | A | | 6/1984 | Brendling | |
| 4,576,599 | A | | 3/1986 | Lipner | |
| 4,590,931 | A | | 5/1986 | Kidwell, Jr. | |
| 4,601,716 | A | | 7/1986 | Smith | |
| 4,668,229 | A | * | 5/1987 | Fago et al. | 604/327 |
| 4,795,450 | A | | 1/1989 | Tovar et al. | |
| 5,065,459 | A | | 11/1991 | Tjahaja et al. | |
| 5,074,853 | A | | 12/1991 | Bryant | |
| 5,085,209 | A | * | 2/1992 | Gottschalk | 600/41 |
| 5,121,755 | A | * | 6/1992 | Hegedusch | 128/844 |
| 5,360,390 | A | * | 11/1994 | Maanum | 600/39 |
| 5,716,350 | A | | 2/1998 | Ryan | |
| 5,735,837 | A | | 4/1998 | Ishikawa | |
| 5,916,187 | A | * | 6/1999 | Brill | 602/21 |
| 5,935,091 | A | | 8/1999 | Friedman | |
| 6,061,840 | A | | 5/2000 | Alligator | |
| 6,145,506 | A | * | 11/2000 | Goll | 128/844 |
| 6,209,142 | B1 | | 4/2001 | Mattsson | |
| 6,336,919 | B1 | | 1/2002 | Davis et al. | |
| 6,479,726 | B1 | * | 11/2002 | Cole | 604/358 |
| 6,487,728 | B1 | * | 12/2002 | Cook | 2/403 |
| 6,580,011 | B1 | * | 6/2003 | Jennings-Spring | 602/41 |

* cited by examiner

*Primary Examiner* — Gloria Hale
(74) *Attorney, Agent, or Firm* — Patricia M. Mathers

(57) ABSTRACT

Device to cover a penis for aesthetic purposes, for visual enhancement, and for various other reasons. The device has a hood that fits over the glans penis and a covering for wrapping about the penis shaft. The device is secured in place by tucking a free end of the covering between layers of wrapped material, or by looping a testicle ring around the base of the testicles.

10 Claims, 3 Drawing Sheets

PENIS COVERING

BACKGROUND INFORMATION

1. Field of the Invention

The invention relates to the field of penis apparel. More particularly, the invention relates to devices for covering the penis.

2. Description of the Prior Art

In many cultures throughout the world and throughout the ages, man has used all manner of adornments to protect and/or accentuate his penis size and for reasons of status or sexual pleasure. Today in the modern Western world, such penile adornments are looked upon as primitive, quaint, or colorful at best. Modern day adornments are typically inconspicuous. Examples of common contemporary adornments include tattooing or piercing the genitalia with rods or jewelry. Such practices are painful, involve potential side effects such as sterility and impotence, are not completely safe, and do not enhance the penis size. Many modern men would enjoy some type of temporary penis adornment, an adornment that provides subtle visual size enhancement of the penis, as perceived through articles of clothing, but without the need for surgery or wearing conspicous and uncomfortable enhancement devices, or simply a type of penis adornment that is colorful and eye-catching in situations of an intimate and erotic nature.

Professionals who frequently stand or perform before an audience, such as teachers, politicians, entertainers, and male dancers wearing tight-fitting costumes, often desire the security of a disposable protective layer for basic undergarment protection and also to guard against embarrassing situations caused by post-urination drip stains or unpleasant odors, etc. Some men don't wear undergarments, but would benefit from wearing a protective layer on the penis to secure movement, to absorb excessive perspiration, to prevent friction burns, and to protect against other similar occurences. For example, runners often wear shorts with a mesh net, but there is still movement of the genitalia resulting in the potential for friction burns or other skin irritations from excessive perspiration.

Penis sheaths and protective devices are known, although primarily as medical or hygiene devices that are used by men suffering from incontinency, to collect inadvertently released urine. These devices are generally bulky, unattractive and uncomfortable. Sanitary pads are also well known, but these are designed to be fitted against the crotch of undergarments worn by women and are not well suited to the anatomy of male genitalia.

What is needed, therefore, is a penis covering or protective barrier that is comfortable and aesthetically pleasing. What is further needed is a penis covering or protective barrier that is disposable and easy to secure in place or remove.

BRIEF SUMMARY OF THE INVENTION

The invention is a penis covering, also referred to as "penis apparel," that is worn on the penis daily to stay fresh before or leading up to critical moments and important situations. The penis apparel may be worn by men of all ages, from the prepubscent to the elderly, for reasons of comfort and/or security. The penis apparel may also be worn simply for pleasure, as an adornment, to serve as a barrier between penis and clothing, to visually enhance the area. The primary purpose of the penis apparel is to enhance a sense of confidence and well-being. Although it is not a medical device, it may also be used to absorb natural discharge and unpleasant odors, to guard against post-urination drip or friction rubs, and for a host of other purposes.

The penis apparel according to the invention comprises a hood for protecting the glans penis and an adjustable covering to be worn on the penis shaft. The covering may be designed to fit over the entire penis and testicles, or be worn just on the penis. The hood may be pre-formed with a separate piece attached to it for the covering, or the hood and covering may be constructed as a single integrated article. The penis apparel is contoured to fit the anatomy of the male sexual organs and may include tape fasteners, loop fasteners, friction hold, straps or adhesive tabs to secure it in place. Many embodiments of the penis apparel will be described. Common to all of them is a fabric device that is adjustable to the anatomy of the user, and that is easily and quickly deployed, positioned, and secured in place, as well as easily and quickly removed.

The materials used to construct the penis apparel or wrap should feel pleasant against the skin, be light and breatheable to allow the passage of air and moisture, and be disposable for a one-time use. The hood is preferably made of a material that will hold a cupped shape, so as to fit the contour of the glans penis. A soft material, such as a cotton or cellulose batting, pre-formed and manufactured to retain a cupped shape is a suitable construction. A construction that includes an outer covering with an inner lining is also suitable. Again, a soft material that is non-irritating to sensitive skin, such as cotton, cellulose batting, or a non-woven material, such as is used in conventional panty liners, is a good choice for the lining. Similar materials may be used for the outer covering, although, since the outer covering will not come into contact with the sensitive skin on the glans penis, more robust materials may also be used. A material that is particularly suitable for the covering that wraps about the shaft of the penis is a woven stretchy material that is conformable to the shape of the penis and capable of accommodating changes in size. Such a material often has a nubbly or bumpy weave or texture, that allows the nubs of one layer of the material to mesh with recesses in an adjacent layer, and is often described as a self-adhesive material, although conventional adhesives are not used. This ability of one layer of the material to adhere to an adjacent layer effectively prevents the material from unwrapping. An example of such a self-adhesive wrap fabric is marketed under the trademark HURT-FREE® tape from Johnson & Johnson Corporation. The tape may contain rubber, latex, or nylon, to provide added stretchiness, although this is not necessary. The fabric may also be made of biodegradable material, such as cotton, or other flushable material that is broken down into its component parts over time.

The penis apparel is easy to deploy, position and secure, and is easily and quickly removed. The penis apparel may be individually packaged in a sterile, small, flat wrapper, which may be discreetly carried in a wallet or pocket, or packaged in any other suitable manner. Depending on the particular embodiment of the penis apparel, the covering may be secured in place by tucking an end between overlapping layers of the covering, by a testicle ring, or, if self-adhesive wrap material is used, simply by wrapping the material and pressing it against the penis shaft.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1A:
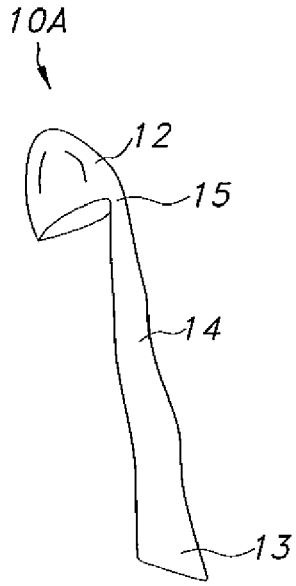
FIG. 1A shows the preferred embodiment of the penis apparel according to the invention.

FIG. 1A shows a preferred embodiment of the penis apparel 10A according to the invention. The penis apparel 10 comprises a covering 14 shaped like a streamer and a hood 12. The covering 14 is attached at an upper end 15 to a hood 12. The covering 14 may be a straight streamer or ribbon, or vary in width along the length of the streamer. A lower end 13 of the covering 14 is unattached. In this preferred embodiment, the covering 14 is a long piece of material that has a wrap dimension at least twice the circumference dimension of the shaft of a penis. The material may be a woven or non-woven fabric, a pressed or felted fabric, a batting material, an elastic or stretchy material, a self-adhesive woven tape or wrap, or other suitable material.

Figure 1B:
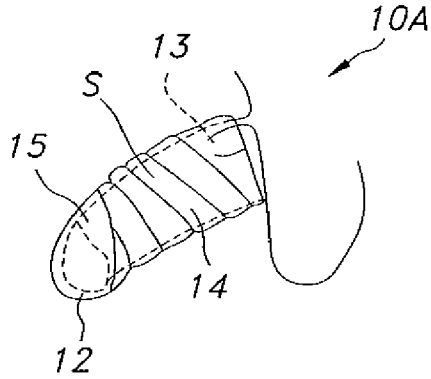
FIG. 1B is an illustration of the penis apparel of FIG. 1A, wrapped about a penis.

FIG. 1B illustrates the penis apparel 10A in use. To deploy the penis apparel 10A, the user fits the hood 12 over the glans penis and wraps the covering 14 in one direction around the penis shaft S so as to cover the penis. The lower fabric end 13 is secured by tucking it under an overlapping layer of the covering 14 as shown. If the user needs to remove the penis apparel 10A to urinate or for other reasons, he simply untucks and unwraps the covering 14 and disposes of the penis apparel 10A.

Figure 2A:
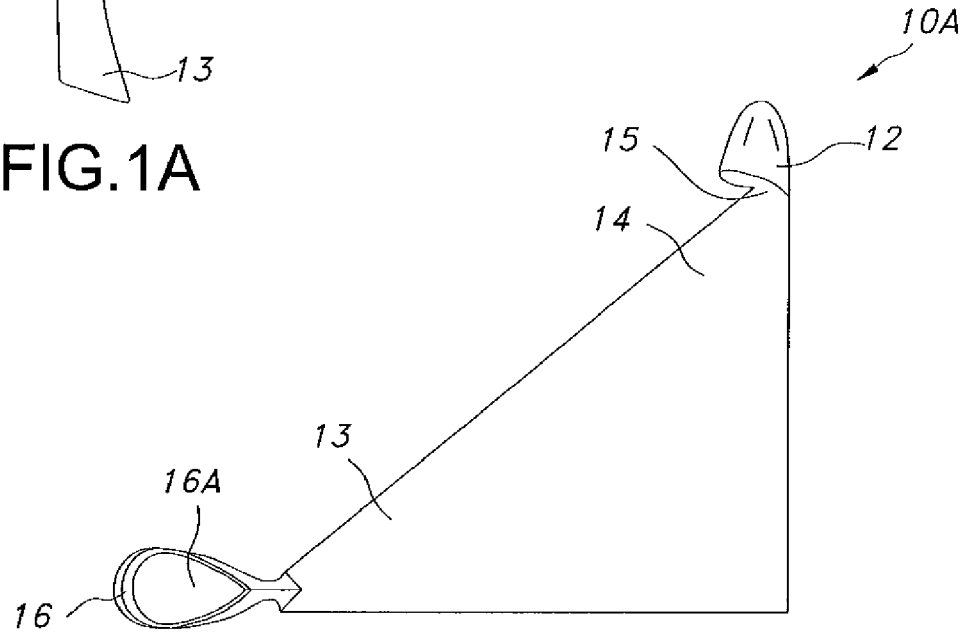
FIG. 2A is a variation of the preferred embodiment of FIG. 1A in which the covering is shaped like a banner.
Figure 2B:
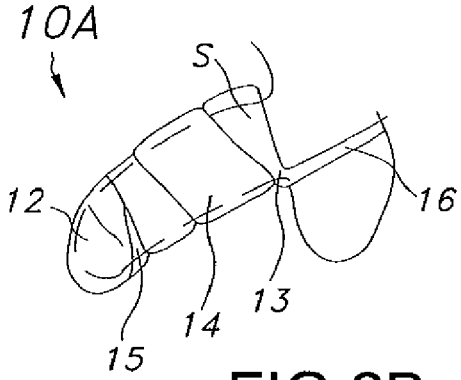
FIG. 2B is an illustration of the penis apparel of FIG. 2A wrapped about a penis.

FIG. 2A shows a variation of the preferred embodiment of FIG. 1A, in which the covering 14 is shaped like a banner; FIG. 2B illustrates how this banner-shaped covering 14 is wrapped around the penis shaft S in one direction and tucked into an overlapping layer. The covering 14, particularly if made of a non-adhesive type of fabric, may be secured with a testicle ring 16 or other appropriate attachment means. The testicle ring 16 is a loop design, attached near the bottom of the covering 14 and is just big enough to allow one testicle at a time to pass through it, so that when both testicles have been pushed through the testicle ring 16, the penis apparel 10A is secured in place. The testicle ring 16 is ideally made of a very stretchy material that is non-irritating to the sensitive skin of the testicles. The user inserts his penis through the testicle ring 16 into the testicle ring opening 16A, pushes the testicles through the ring and then wraps the covering 14 around the penis shaft S. It is understood that the covering 14 may be any appropriate shape, size and length, depending on the size and shape of a penis, and is not limited to the two above-mentioned variations. The penis apparel 10A may include different colors, designs, pictures, or other ornamental features and may be scented, unscented, flavored or include other desirable features.

Figure 3A:
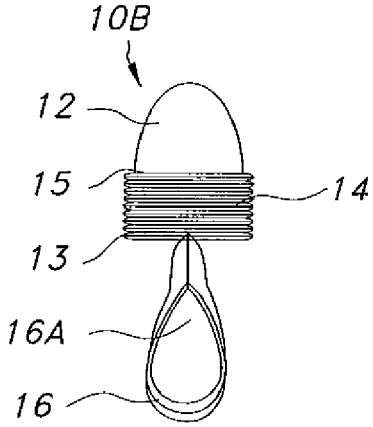
FIG. 3A shows a second embodiment of the penis apparel according to the invention, in which the covering depends from the hood like a skirt. A testicle ring is attached to the skirt.
Figure 3B:
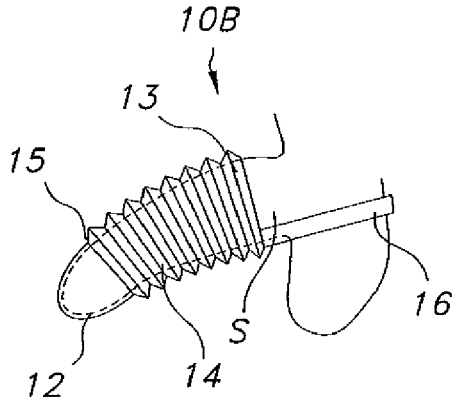
FIG. 3B is an illustration of the penis wrap of FIG. 3A, pulled up the penis shaft and secured with the testicle ring.

FIG. 3A shows a second embodiment of a penis apparel 10B according to the invention, in which the covering 14 is a pleated construction that encircles and depends from the hood 12 like a skirt. In the embodiment shown, the covering 14 is pleated to accommodate any penis size or shape and may expand if the penis evolves from a flaccid to erect condition. To deploy, position and secure the penis apparel 10B when the penis is in a flaccid state, the user places the penis into the covering 14, with the hood 12 resting on the glans penis, and pulls the covering 14 up the penis shaft S towards the body as shown in FIG. 3B. If the covering 14 is made of self-adhesive woven tape, it is lightly squeezed to secure the penis apparel 10B in place about the shaft S. The covering 14, particularly if made of a non-adhesive type of fabric, may be secured with a testicle ring 16 or other appropriate attachment means.

Figure 4A:
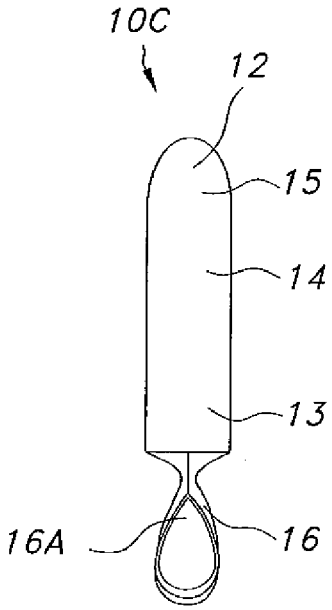
FIG. 4A shows the third embodiment of the penis apparel according to the invention with testicle ring.
Figure 4B:
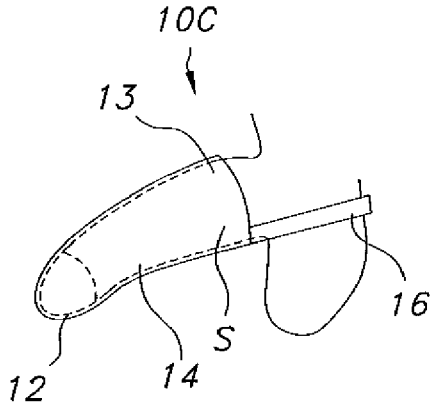
FIG. 4B is an illustration of the penis apparel of FIG. 4A, covering the penis shaft.

FIG. 4A shows a third embodiment of a penis apparel 10C according to the invention, wherein the covering 14 and hood 12 are a sock-like device. The hood 12 may be one continuous piece of fabric with the covering 14 or may be a separate pre-formed piece attached to the upper end 15 of the covering 14. FIG. 4B illustrates this third embodiment of the penis apparel 10C pulled over the shaft S of a flaccid penis and secured in place with a testicle ring 16. It is understood that the penis apparel 10C may be secured on the penis in any appropriate manner and is not limited to the mentioned security means. For example, if the covering 14 is made of a self-adhesive fabric, simply pressing the covering 14 against the shaft S may be an effective means of securing the apparel in place and eliminate the need for the testicle ring 16.

Figure 5A:
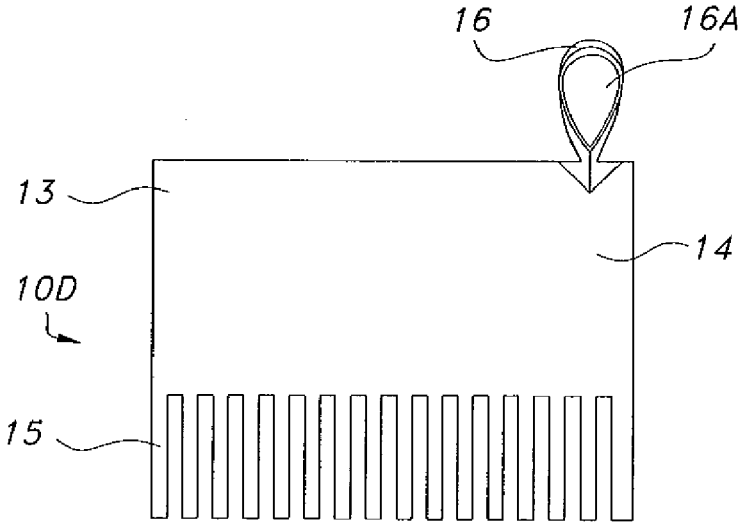
FIG. 5A shows a fourth embodiment of the penis apparel according to the invention with a crenulated edge and testicle ring.
Figure 5B:
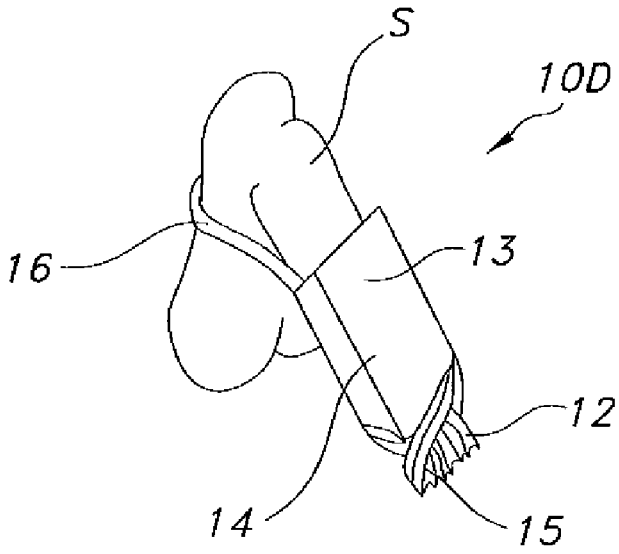
FIG. 5B shows the embodiment of FIG. 5A wrapped about the penis and twisted, with the testicle ring encircling the base of the testicles.

FIG. 5A shows a fourth embodiment of the penis apparel 10D according to the invention, in which the covering 14 has an upper end 15 that is crenulated. The covering 14 is a flat sheet of fabric and may be any suitable shape for wrapping around the shaft S of a penis, such as, for example, a square rectangular, or triangular shape. The user wraps the covering 14 around the shaft S of the penis with the glans penis placed just beneath the upper crenulated end 15. The upper crenulated end 15 is then twisted closed to form the hood 12, as shown in FIG. 5B. A testicle ring 16 may be attached to the lower end 13 to secure the penis apparel 10D in place or the twisted upper end 15 may be tucked down into the wrapping or secured in place by other fastening methods. The penis apparel 10D may also be made of self-woven adhesive tape and lightly squeezed to secure in place.

Figure 6A:
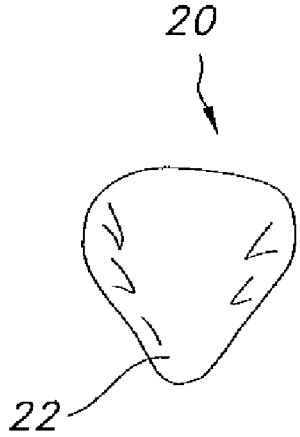
FIG. 6A shows the fifth embodiment of the penis apparel shaped like a cup.
Figure 6B:
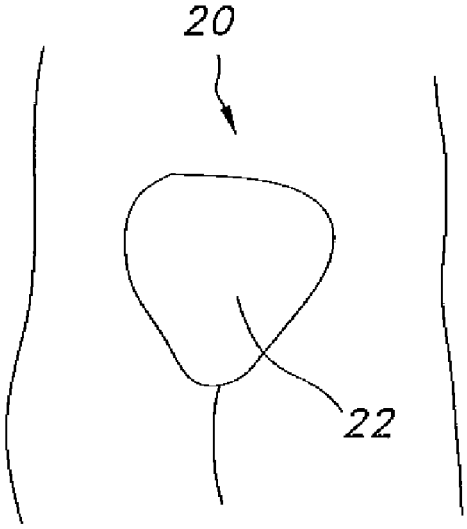
FIG. 6B shows the embodiment of FIG. 6A fitted against the body.

FIG. 6A shows a fifth embodiment of a penis apparel 20 according to the invention. The penis apparel 20 is a pre-formed cup 22 that may be inserted into briefs or inside a protective sports cup. The cup 22 encases the entire penis and testicles. When used inside a sports cup, it acts as a shield between a plastic sports cup and the body, to prevent friction burns on the skin. When used without the sports cup, it acts as a barrier between the penis and clothing. The cup 20 may be made or lined with a soft lambs wool or fleece, or any suitable absorbent material such as cotton. FIG. 6B shows the embodiment of FIG. 6A worn inside briefs. The user simply places the cup 20 inside the overlap pocket in the briefs, where it is held in place between the undergarment and the genitalia. If worn without wearing a pair of briefs, the cup 20 may be secured by a strap, waistband, or double-sided tape with a friction coating on the outer surface of the cup to enhance adhesion to the clothing of the wearer.

The penis apparel 10A-10D or 20 is a personal care item, to be worn by men to provide a barrier between the penis and clothing, provide aesthetic appeal, provide size enhancement, or for various other personal reasons. Depending on the particular reason, certain materials or fabrics may be more suitable than others. Thus, the penis apparel 10A-10D and 20 may be constructed from a wide range of materials. Woven or non-woven textiles, such as those made of cotton, hemp, bamboo, abaca, or other natural fibers, or combinations of fibers, natural and/or synthetic, may be used to construct a wrap fabric that is soft, comfortable against the skin, and suitably flexible. Textiles made with synthetic fiber or a foam material, biodegradable and/or disposable, may also be suitable. Due to the nature of the penis, which can change significantly in size, depending on whether the penis is in a flaccid or erect state, it may be desirable to construct the penis apparel 10A-10D and 20, or at least the covering 14, from a material with elastic or stretch properties. The penis apparel 10A-10D may also have score and/or origami fold lines, including perforations or indentations, to facilitate folding and or compression, to increase pressure and to customize fit.

It is understood that the embodiments described herein are merely illustrative of the present invention. Variations in the construction of the penis wrap may be contemplated by one skilled in the art without limiting the intended scope of the invention herein disclosed and as defined by the following claims.

What is claimed is:

1. A device for encasing a penis having a penis shaft and a glans penis, said device comprising:

a hood constructed of an absorbent material to absorb body fluid, said hood adapted to fit on said glans penis; and a covering that is a flat fabric sheet, adapted for encasing said penis shaft, said covering being attached to said hood;

wherein said penis shaft has a circumference dimension, and wherein said covering has a wrap dimension that is at least twice said circumference dimension, so as to be wrappable about said penis shaft with an overlap of said fabric sheet, such that a second portion of said fabric sheet wraps onto a first portion of said fabric sheet, with said first portion then forming an underlying layer and said second portion forming an outer layer on top of at least a portion of said underlying layer.

2. The device of claim 1, wherein said covering is a ribbon of said fabric sheet, wherein a length dimension of said ribbon is said wrap dimension, wherein said ribbon has a first end that is attached to said hood and a free end, and wherein said ribbon is wrappable at least twice about said circumference dimension of said penis shaft.

3. The device of claim 2, wherein, when said ribbon is wrapped about said penis shaft, said covering is securable on said penis shaft by tucking said free end under an underlying layer of said wrapped ribbon.

4. The device of claim 2, wherein said wrap dimension of said ribbon is at least three times said circumference dimension and, wherein, when said ribbon is wrapped about said penis shaft, said covering is securable on said penis shaft by tucking said free end between said outer layer and said underlying layer of said wrapped ribbon.

5. The device of claim 1, wherein said fabric sheet is triangular in shape, having a first corner, a second corner, and a third corner, with said hood attached to said first corner of said triangle and wherein said first portion of said fabric sheet extends between said first corner and said second corner and forms said underlying layer and said second portion of said fabric sheet extends from said first portion toward said third corner and forms said outer layer that is wrapped about said penis shaft over said underlying layer.

6. The device of claim 5, wherein, when said covering is wrapped about said penis shaft, said covering is securable on said penis shaft by tucking said third corner under said outer layer of said fabric sheet.

7. The device of claim 5, wherein, when said covering is wrapped about said penis shaft, said covering is securable on said penis shaft by tucking said third corner between said outer layer and said underlying layer of said fabric sheet.

8. The device of claim 1, wherein said covering is also constructed of an absorbent material.

9. The device of claim 5, further comprising a testicle ring that is attached to said second corner of said triangle.

10. The device of claim 1, further comprising a testicle ring that is attached to said covering.

* * * * *